US005697105A

United States Patent [19]

White

[11] Patent Number: 5,697,105

[45] Date of Patent: Dec. 16, 1997

[54] HUNTING MASK

[76] Inventor: Mark White, 1604 Longshore, Ann Arbor, Mich. 48105

[21] Appl. No.: 707,528

[22] Filed: Sep. 4, 1996

[51] Int. Cl.[6] ..... A41D 13/00; A62B 7/10

[52] U.S. Cl. ..... 2/206; 128/206.15; 128/208.27; 128/205.28; 128/206.13

[58] Field of Search ..... 2/206; 120/205.27, 120/205.28, 206.12, 206.13, 206.15

[56] References Cited

U.S. PATENT DOCUMENTS

| | | | |
|---|---|---|---|
| 3,276,445 | 10/1966 | Largdon | 128/205.15 |
| 3,661,070 | 5/1972 | Miller | 98/68 |
| 4,285,068 | 8/1981 | Ross | 2/202 |
| 4,382,440 | 5/1983 | Kapp et al. | 128/205.28 |
| 4,549,543 | 10/1985 | Moun | 128/206.15 |
| 4,723,542 | 2/1988 | Gifford | 128/206.15 |
| 4,856,308 | 8/1989 | Tayobi | 128/205.15 |
| 4,981,134 | 1/1991 | Courtney | 128/206.15 |
| 5,025,507 | 6/1991 | Kirby | 2/206 |
| 5,091,996 | 3/1992 | Kirby | 2/206 |
| 5,117,821 | 6/1992 | White | 128/206 |
| 5,226,189 | 7/1993 | Blutstein | 2/4 |
| 5,269,294 | 12/1993 | Rogozinski | 128/205.27 |
| 5,273,134 | 12/1993 | Von Blücher et al. | 128/205.28 |
| 5,383,236 | 1/1995 | Sesselmann | 2/243.1 |
| 5,413,094 | 5/1995 | McBrearty | 128/200.24 |
| 5,511,541 | 4/1996 | Dearstine | 128/201.13 |
| 5,538,013 | 7/1996 | Brannon | 2/206 |

FOREIGN PATENT DOCUMENTS

| | | | |
|---|---|---|---|
| 3725282 | 6/1988 | Germany | 128/205.28 |
| 92110 | 5/1936 | Sweden | 2/206 |

*Primary Examiner*—Bibhu Mohanty
*Attorney, Agent, or Firm*—Gifford,Krass,Groh,Sprinkle,Patmore,Anderson&Citkowski

[57] ABSTRACT

A facial mask eliminates odors from the exhalation of a wearer while permitting detection by the wearer of odors a the surrounding environment. In the preferred embodiment, the invention takes the form of an air permeable facial covering disposed over the mouth and nose of the wearer, including elements for absorbing exhalation odors impregnated therein. At least one single direction inlet valve is disposed in the air permeable facial covering thereby providing an incoming air passageway through which ambient air may pass without passing through the means for absorbing exhalation odors. Elements for securing the perimeter of the air permeable facial covering to the wearer, such as an elastic band, is provided so that the exhalation of the wearer must pass through the elements for absorbing exhalation odors and may not escape around the perimeter of the air permeable facial covering.

4 Claims, 1 Drawing Sheet

HUNTING MASK

FIELD OF THE INVENTION

This invention relates generally to facial masks, and more particularly to such a mask which reduces odors from the exhalation of the wearer, for example, while hunting.

BACKGROUND OF THE INVENTION

Individuals who engage in activities such as hunting, photography, or studies of animals in their natural habitat are well acquainted with the difficulty in approaching wildlife without alerting the wildlife to the individual's presence. It is well known that most animals have well-developed senses of sight and smell, and individuals attempting to approach wildlife in its natural habitat must camouflage their visual image and mask or eliminate their odor. It is believed that the primary odor detected by animals is the odor carried in the exhalation of the individual.

While eliminating the odor of the wearer is important to hide the presence of the wearer, it is also important that the wearer retain the ability to detect odors in their environment. In a potentially hostile environment, individuals must maintain the fullest use of their senses.

A variety of masks are available to assist individuals to remain undetected when approaching wildlife. For example, U.S. Pat. No. 5,091,996 to Kirby discloses a camouflage face mask which is positioned in a close fitting relationship to the skin of an individual's face. While the mask disclosed by Kirby may be worn with relative comfort and enables visual concealment of the individual from nearby animals, the mask does not disclose means by which the odor of the individual is concealed from nearby wildlife. U.S. Pat. Nos. 5,226,189 to Blutstein and 4,285,068 to Ross both disclose camouflage devices suitable for wearing about the head which prevent visual detection of the hunter by nearby wildlife, but neither Ross or Blutstein address the concealment or elimination of odors contained in the exhalation of an individual so as to prevent detection of the odor of the individual by nearby wildlife.

U.S. Pat. No. 5,511,541 to Dearstine discloses a warm air mask comprising a facial covering which encompasses the nose and mouth of a wearer, the mask having a plurality of oval inhale ports which extend through the mask such that, as the wearer inhales, the inhale ports are opened. Upon subsequent exhalation by the wearer, the inhale ports close and an exhale port opens. Upon inhalation, the exhale port closes. The mask disclosed in Dearstine is directed to providing a mask which keeps the face of the wearer warm and dry, and does not eliminate odors from the exhalation of the wearer.

U.S. Pat. No. 5,269,294 to Rogozinski discloses a face mask impregnated with an odor-absorbing material which eliminates organic gaseous compounds from the air inhaled through the mask, thus reducing the gaseous foul odors inhaled through the mask, thus reducing the wearer's perception of odors. While this mask enables reduced detection of odors by the wearer, it does not provide a filtering action for reduction of odors in the exhalation of the wearer which pass into the ambient atmosphere.

U.S. Pat. No. 5,117,821 to White discloses a hunting mask with a breath odor control system which includes a face mask having a one-way air intake valve and a tube for conducting a hunter's exhalation from the mask to an intake end of an air purification canister. The air purification canister has, at its other end, a one-way discharge valve such that filtered breath may be discharged to the ambient atmosphere once odors have been removed from the exhalation. The device disclosed by White, while providing a method for filtering odors from the exhalation of a hunter or other individual, is bulky and difficult to use as the purifying canister must be attached to the wearing apparel of the individual. This causes discomfort and additional weight which the hunter or other individual must support over a potentially long period of time.

U.S. Pat. No. 5,383,236 to Sesselmann discloses a variety of articles of clothing which absorb odors emanating from the portion of the person which is substantially surrounded by the clothing, thereby preventing odors from escaping to the atmosphere for detection by nearly wildlife. In particular, Sesselmann discloses a breath shield which is intended to be placed over the nose and mouth of a wearer which may be integrated into a larger head covering. The breath shield disclosed by Sesselmann contains an odor absorbing means in the form of fibers treated with activated carbon or charcoal. All air inhaled by the wearer of the mask disclosed by Sesselmann must pass through the odor absorbing material, thereby significantly reducing the ability of the wearer to detect odors in the surrounding environment. Individuals in remote areas depend upon their sense of smell to detect odors related to the surrounding environment such as smoke, a fetid marsh or the presence of a decaying animal. The mask disclosed by Sesselmann does not permit full use of the wearer's sense of smell, thus reducing the ability of the wearer to properly function in a wilderness environment.

Thus, there remains a need for a mask which eliminates odors from the exhalation of a wearer while permitting the wearer to breath more easily while detecting the odors present in the surrounding environment.

SUMMARY OF THE INVENTION

The present invention improves upon previous masks by providing a mask which eliminates odors from the exhalation of the wearer while permitting the wearer to easily inhale unfiltered air, thereby enabling the wearer to breath more comfortably while still being able to detect odors present in the surrounding environment. In the preferred embodiment, the invention takes the form of an air permeable facial covering disposed over the mouth and nose of the wearer. Means for absorbing exhalation odors such as activated charcoal or carbon are disposed in the air permeable facial covering such that exhalation odors are absorbed when passing therethrough.

At least one, single-direction inlet valve is supported on the air permeable facial covering to provide an incoming air passageway which permits ambient air to enter the mask which has not passed through the means for absorbing exhalation odors. Limiting air flow through the odor-absorbing material may be important so as not to consume or saturate the capabilities of such material. The exhalation of the wearer is prevented from passing through the incoming air passageway, however, through the action of the single direction inlet valve. Additionally, means for securing the facial covering to the wearer is provided with a relatively tight peripheral fit so that the exhalation of the individual may not pass exteriorly of the facial covering except by passing through the means for absorbing exhalation odors. Optionally, the exterior of the air permeable facial covering may include a camouflage pattern.

DETAILED DESCRIPTION OF THE PREFERRED EMBODIMENT

Figure 1:
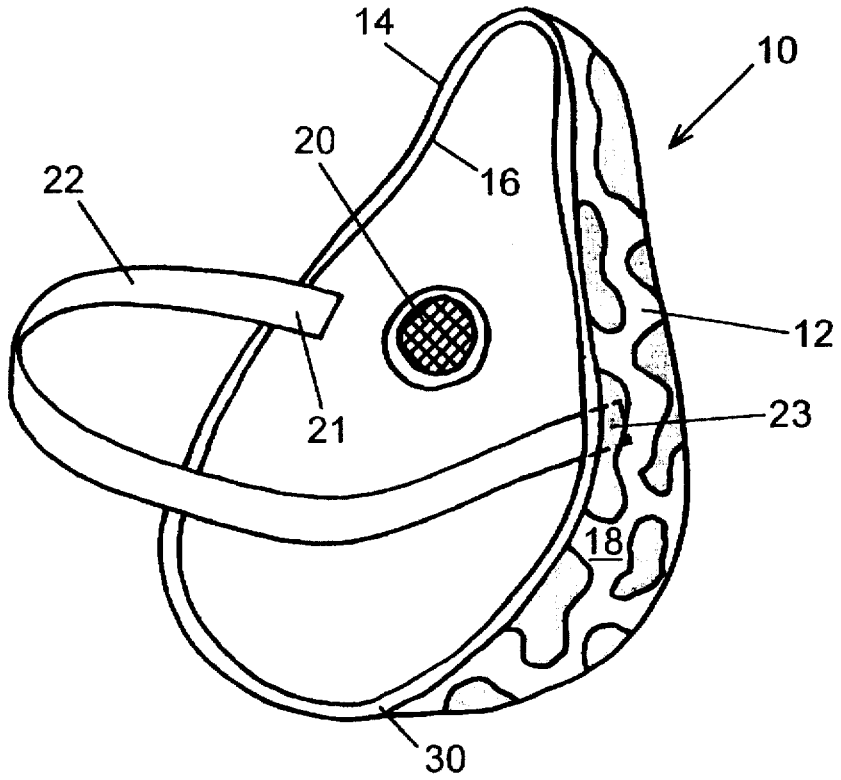
FIG. 1 illustrates a preferred embodiment of the invention.
Figure 2:
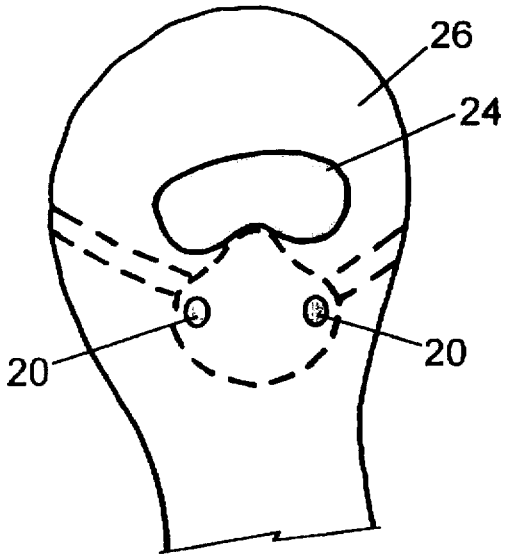
FIG. 2 illustrates an alternate embodiment of the present invention, wherein an air permeable facial covering is included in a hood.

A preferred embodiment of the invention is depicted generally at 10 in FIG. 1. An air permeable facial covering in the form of a mask 12 is shown having an interior 16, an exterior surface 18 and a perimeter 14, and is configured to fit comfortably over the nose and mouth of a wearer. Means for absorbing exhalation odors are provided so that air exiting the facial covering 12 must pass through the means for absorbing odors. An odor absorbing element such as activated charcoal is preferably provided between two cloth layers comprising cotton, wool, felt, or polyester. The cloth layers may be stitched together in a quilted fashion so that the odor absorbing element is contained within small, discrete pockets. The stitching is preferably sealed so as to prevent exhalation air from passing exteriorly of the facial covering without passing through the means for absorbing exhalation odors. Alternatively, the fibers of one or more cloth layers may be treated with an odor absorbing element so that the odor absorbing element is integral to the cloth layers of the mask. As taught in U.S. Pat. No. 5,383.236 to Sesselmann, one of a number of alternate methods for including an odor absorbing means within a section of cloth may be utilized. Additionally, a variety of substances may be used as an odor absorbing element, including one or more of the following, either singly or in combination: activated alumina, chlorophyll, zeolite, soda lime, calcium oxide, potassium permanganate, or baking soda. In the preferred embodiment of the invention, activated charcoal or carbon is utilized.

A single-direction inlet valve 20, such as a flap valve, is disposed in the air permeable facial covering so as to provide an incoming air passageway through which ambient air may pass without passing through the activated charcoal or other means for absorbing exhalation odors. This enables the wearer to inhale unfiltered air and detect odors present in the wearer's environment. Optionally, two or more single direction inlet valves may be provided.

Optionally, a sealing member 30 may be secured to the perimeter 14 of the mask 12 to ensure that exhalation of the wearer does not pass exteriorly of the mask without passing through the means for absorbing odors. The sealing member may be comprised of a non-permeable flexible material such as plastic or rubber.

An elastic strap 22 having two ends 23 and 21 is provided for securing the mask to the head of the wearer. As shown in FIG. 1, ends 21 and 23 are attached to the interior 16 of air permeable facial covering 12, but may alternately be attached to the exterior 18 or perimeter 14. Ends 21 and 23 may be attached to the air permeable facial covering 12 by stitching, adhesive, or other fastening techniques. The elastic strap 22 may be removable from the air permeable facial covering 12 so as to enable replacement or adjustment of elastic strap 22.

Optionally, the exterior surface 18 of the air permeable facial covering includes a camouflage pattern so as to enhance the visual concealment of the wearer.

Having described the various embodiments of the present invention with reference to the accompanying figures, it will be appreciated that various changes and modifications can be made without departing from the scope or spirit of the invention.

I claim:

1. A hunting mask adapted for eliminating odors in the exhalation of a wearer, consisting of:

an air-permeable facial covering including a sealing member providing a relatively tight peripheral fit against contours of the nose and mouth of the wearer, the mask further including an exterior surface with a camouflage pattern;

means for securing the facial covering over the mouth and the nose of the wearer;

air permeable, odor absorbing activated charcoal disposed throughout the air permeable facial covering; and at least one, single-direction flap valve supported on the air permeable facial covering providing an incoming air passageway permitting ambient air to be inhaled directly by the wearer without passing through the activated charcoal, thereby enabling the directly inhaled ambient air to enter the mask at a rate in excess of that entering through the air permeable facial covering.

2. The hunting mask of claim 1, wherein the activated charcoal is contained in a plurality of interconnected pockets stitched together throughout the facial covering.

3. A hunting mask adapted for eliminating odors in the exhalation of a wearer, consisting of:

an air-permeable facial covering including a sealing member providing a relatively tight peripheral fit against contours of the nose and mouth of the wearer, the mask further including an exterior surface with a camouflage pattern;

means for securing the facial covering over the mouth and the nose of the wearer;

air permeable, odor absorbing activated alumina disposed throughout the air permeable facial covering; and at least one, single-direction flap valve supported on the air permeable facial covering providing an incoming air passageway permitting ambient air to be inhaled directly by the wearer without passing through the activated alumina, thereby enabling the directly inhaled ambient air to enter the mask at a rate in excess of that entering through the air permeable facial covering.

4. The hunting mask of claim 3, wherein the activated alumina is contained in a plurality of interconnected pockets stitched together throughout the facial covering.

* * * * *